US006119700A

United States Patent [19]

Fleischhauer et al.

[11] Patent Number: 6,119,700

[45] Date of Patent: Sep. 19, 2000

[54] BRUSH CLEANING UNIT FOR THE HEATER FIXTURE OF A SMOKING DEVICE

[75] Inventors: Grier Fleischhauer, Midlothian; Brett Stevenson, Richmond, both of Va.

[73] Assignee: Philip Morris Incorporated, New York, N.Y.

[21] Appl. No.: 09/188,446

[22] Filed: Nov. 10, 1998

[51] Int. Cl.[7] ..... A24F 3/02

[52] U.S. Cl. ..... 131/243; 131/244; 15/104.16; 15/104.2

[58] Field of Search ..... 131/243, 244, 131/245; 15/304, 316.1, 395, 406, 104.05, 104.16, 104.2, 104.03, 160, 164; 285/8, 148.22; 134/196, 197, 117

[56] References Cited

U.S. PATENT DOCUMENTS

| | | | |
|---|---|---|---|
| 1,644,574 | 10/1927 | Fitzgerald | 131/243 |
| 2,164,856 | 7/1939 | Lyons et al. | 131/243 |
| 2,480,167 | 8/1949 | Thomas | 131/243 |
| 2,590,479 | 3/1952 | Thomas | 131/243 |
| 5,035,796 | 7/1991 | Saylor et al. | 210/198 |
| 5,388,594 | 2/1995 | Counts et al. | 131/329 |
| 5,505,214 | 4/1996 | Collins et al. | 131/194 |
| 5,530,225 | 6/1996 | Hajaligol | 219/535 |
| 5,591,368 | 1/1997 | Fleischhauer et al. | 219/535 |
| 5,878,752 | 3/1999 | Adams et al. | 131/329 |

*Primary Examiner*—Stanley S. Silverman
*Assistant Examiner*—Robert E. McBride
*Attorney, Agent, or Firm*—Burns, Doane, Swecker & Mathis, LLP

[57] ABSTRACT

A brush cleaning unit for a heater fixture of a smoking device includes a tube having a first end and a second end, the tube including a portion of a key for cooperating with a corresponding portion of the key on a heater fixture for attaching and orienting the heater fixture relative to the tube. The brush cleaning unit also includes a brush attached to the tube. The brush is axially movable relative to the tube and the heater fixture attached thereto. The brush is non-rotatable relative to the tube. A method for cleaning a heater fixture is also disclosed.

16 Claims, 4 Drawing Sheets

BRUSH CLEANING UNIT FOR THE HEATER FIXTURE OF A SMOKING DEVICE

FIELD OF THE INVENTION

The invention relates to a cleaning unit for use with a component of a cigarette smoking system. More particularly, the invention relates to a cleaning unit which cleans the component via a brush apparatus.

BACKGROUND OF THE INVENTION

Commonly assigned U.S. Pat. Nos. 5,388,594; 5,505,214; 5,530,225; and 5,591,368 disclose various electrically powered smoking systems comprising electric lighters and cigarettes and are hereby expressly incorporated by reference. The systems provide smoking pleasure while significantly reducing side stream smoke and permitting the smoker to selectively suspend and reinitiate smoking. During operation of such smoking systems, condensate can collect on various parts of the heating fixture. In order to remove such condensates, the smoking device may include a heating component which is used to drive off such condensates. Even with such a heating component, it may not be possible to remove as much of the condensates as desired. Further, the smoking pleasure derived from the smoking system may be adversely affected by condensate build-up in areas which cannot be sufficiently heated to drive off the condensates.

Commonly assigned U.S. patent application Ser. No. 09/176,028 (attorney Docket No. 021238-264) entitled, "Cleaning Unit for the Heater Fixture of a Smoking Device", inventors Joe Banyasz et al., filed Oct. 21, 1998, discloses several embodiments of cleaning units for spraying water on selected locations of a heater fixture to remove condensate, and is expressly incorporated by reference. A difficulty with these cleaning units is the need to have a sufficient supply of water, usually a conventional tap, to remove the condensate with running water over a period of time. These cleaning units are typically connected to the tap, and may not be able to be easily used if a standard tap is not available. It is desirable to provide a cleaning device that does not require a large amount of water to remove condensates from a heater fixture, and that need not be connected to a water supply tap.

SUMMARY OF THE INVENTION

According to one aspect of the present invention, a brush cleaning unit for a heater fixture of a smoking device includes a tube having a first end and a second end, the tube including a portion of a key for cooperating with a corresponding portion of the key on a heater fixture for attaching and orienting the heater fixture relative to the tube. The brush cleaning unit also includes a brush attached to the tube. The brush is axially movable relative to the tube and the heater fixture attached thereto. The brush is non-rotatable relative to the tube.

According to another aspect of the present invention, a method for cleaning a heater fixture of a smoking device is disclosed. According to the method, a heater fixture is attached to the second end of a tube having a first and a second end. An aqueous medium is supplied to the first end of the tube such that the aqueous medium flows through the tube and an opening in the heater fixture and out the second end of the tube. A bristled portion of a brush, the brush having a handle disposed in and axially movable relative to an opening through a wall of the tube, is moved through the opening in the heater fixture.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION OF THE PREFERRED EMBODIMENTS

Figure 1:
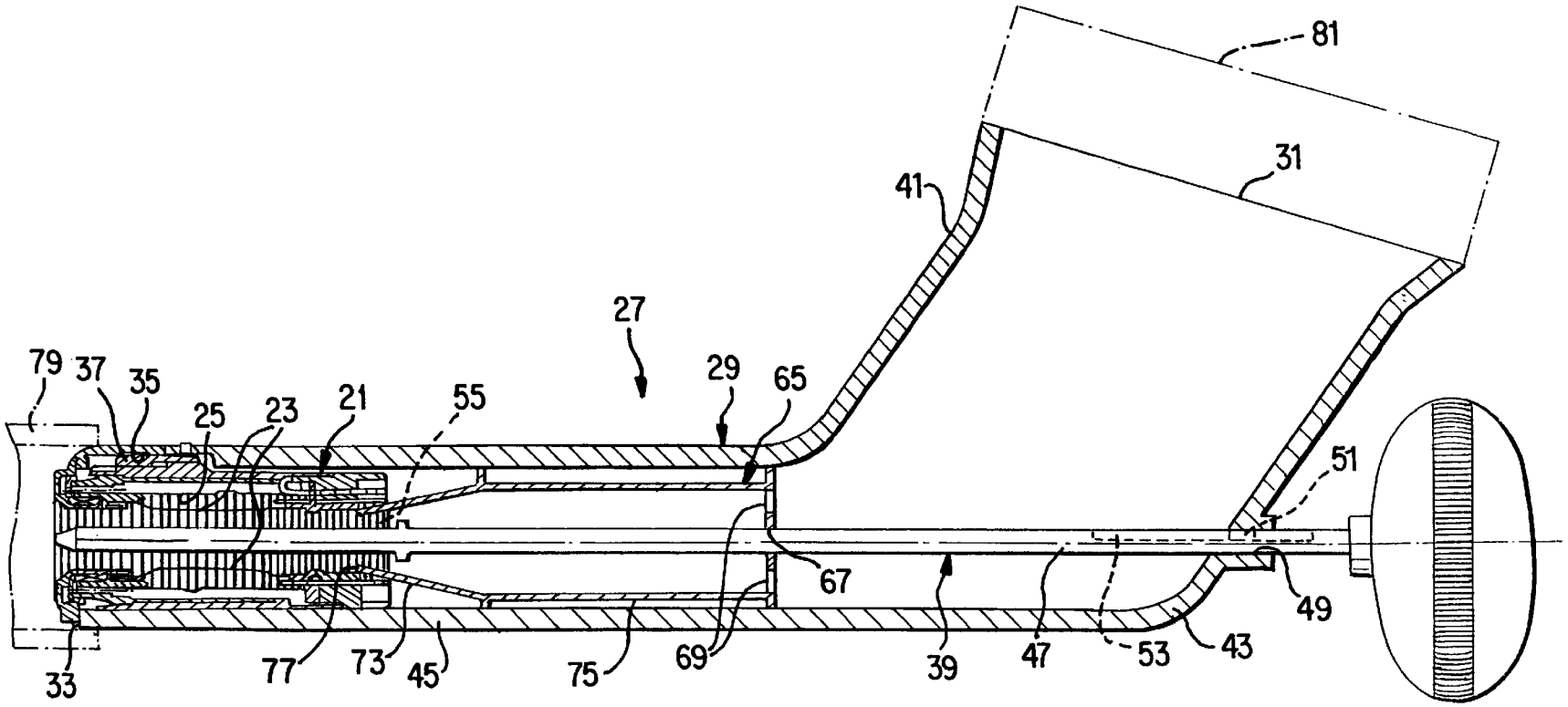
FIG. 1 is a schematic, cross-sectional side view of a brush cleaning unit according to an embodiment of the present invention.
Figure 5:
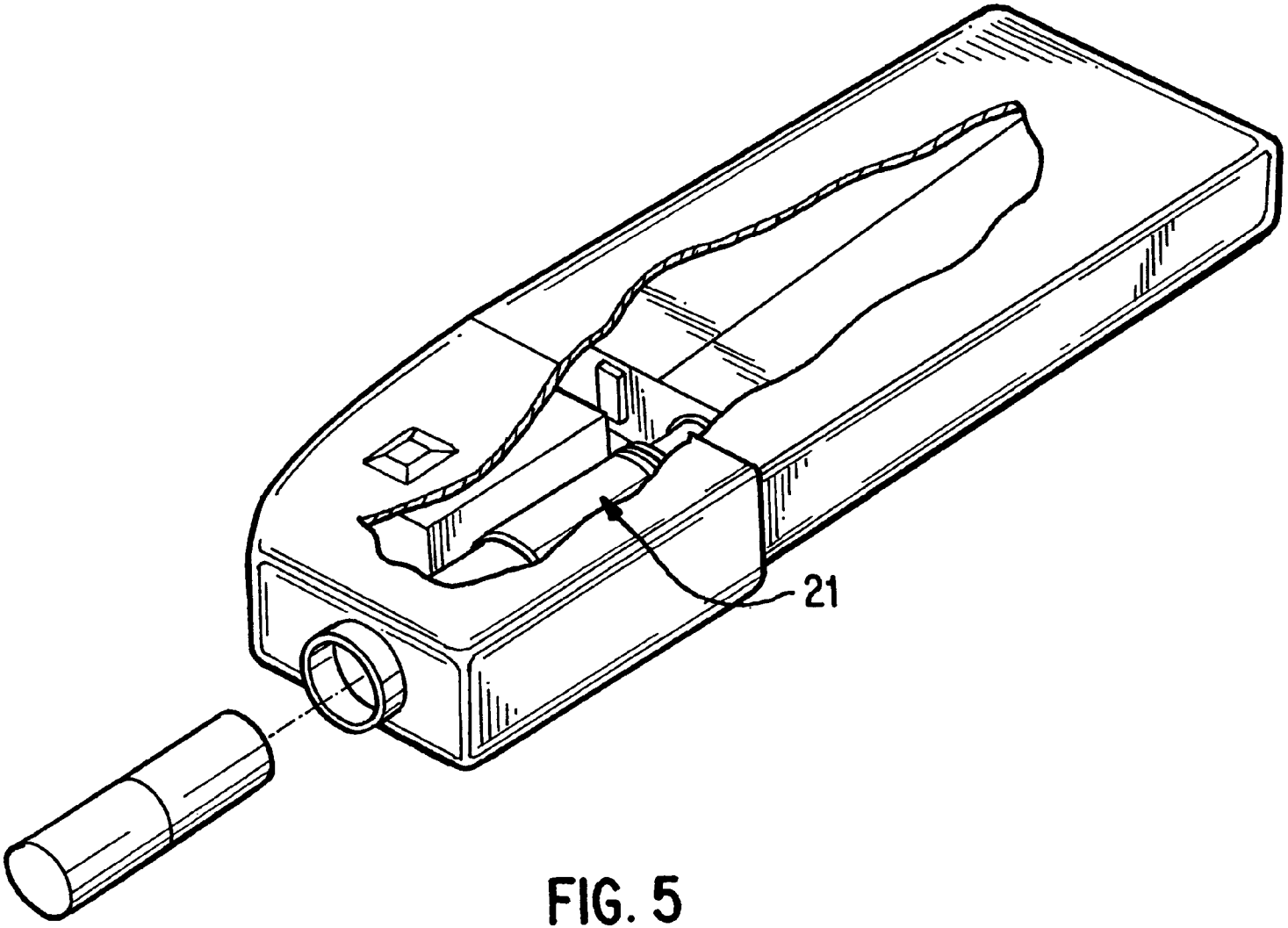
FIG. 5 is a schematic, perspective view of a smoking system according to an embodiment of the present invention.

U.S. Pat. Nos. 5,388,594; 5,505,214; 5,530,225; and 5,591,368 disclose various electrically powered smoking systems comprising electric lighters and cigarettes and are hereby expressly incorporated by reference. A smoking system representative of the type of smoking systems with which the present invention is usable is shown in FIG. 5. As seen in FIGS. 1 and 5, the electric lighters or heating fixtures of these smoking systems are typically tubular elements 21 with two open ends. As seen in FIG. 1, a plurality of mutually parallel, longitudinal heater blades 23 are arranged along an interior periphery of the tube and, in use, contact a specially adapted cigarette to heat the cigarette. The heater blades 23 are surrounded by a cylindrical can 25. During smoking, condensates can build up on the can 25 and the blades 23. Portions of the blades 23 are heated to very high temperatures so that some condensates adjacent the blades are sometimes charred. Condensates on the tips of the heater blades 23 are less easily removed. It has been determined that it is desirable to periodically clean the heater fixture to remove condensates from the heater blades 23, the can 25, and adjacent portions of the tube 21.

A brush cleaning unit 27 according to an embodiment of the present invention is shown in FIG. 1. The unit 27 includes a tube 29 having a first end 31 and a second end 33. The tube 29 includes a portion 35 of a key for cooperating with a corresponding portion 37 of the key on the heater fixture 21 for attaching and orienting the heater fixture relative to the tube.

Presently preferred heater fixtures 21 have retractable pins or prongs for securing the heater fixture to a power supply and control portion of the electrical smoking system by mating with a corresponding opening in the power supply and control portion. It is preferred that such a retractable pin or prong forms the corresponding portion 37 of the key and that the portion 35 of the key is in the form of a pin or prong receiving opening in the tube 29. The key formed by the portion 35 and the corresponding portion 37 preferably prevents axial or rotational movement of the heater fixture 21 when the portion and the corresponding portion mate. If desired or necessary, the key may prevent only rotational movement, and another structure, such as a compression fit between the heater fixture 21 and the tube 29 or an O-ring (not shown) disposed in a groove (not shown) inside of the tube, may be provided to prevent or limit axial movement.

In addition to the tube 29, the brush cleaning unit 27 includes a brush 39 attached to the tube and axially movable relative to the tube and the heater fixture attached thereto. The brush 39 is non-rotatable relative to the tube.

The tube 29 preferably includes a first straight length 41 extending from the first end 31 to a bent portion 43, and a second straight length 45 extending from the bent portion to the second end 33. The straight lengths 41 and 45 are preferably straight in the sense that they are substantially symmetrical about a straight axis. As seen in FIG. 1, the first end 31 preferably has a larger inside dimension $D_1$ than the inside dimension $D_b$ of the bent portion 43 and is preferably funnel-shaped to facilitate introduction of an aqueous medium, such as water, into the first end of the tube 29.

The brush 39 preferably includes a handle portion 47 extending from outside of the tube 29 through an opening 49 in the bent portion 43 to inside of the second straight length 45. The handle portion 47 and the opening 49 are preferably non-circular, such as by being triangular, square, pentagonal, etc., and/or by virtue of being formed with a second key 51 and a receptacle 53 for the second key in which the second key is axially movable, such as an otherwise circular handle with a key or key receptacle extending along its length or a portion of its length.

A plurality of bristles 55 are preferably attached to the handle 47 and arranged in a plurality of longitudinal rows corresponding to locations of spaces between longitudinally arranged heater elements or blades 23 in the heater fixture. More particularly, the bristles 55 are preferably arranged in rows to fit between the heater blades 23 so that the bristles impinge upon the can 25 without contacting the delicate blades. Because the brush 39 is non-rotatable relative to the tube 29, if the heater fixture 21 is also non-rotatable relative to the tube, the possibility of damage to the blades 23 from contact with the bristles 55 is reduced and the life of the heater fixture is prolonged.

Figure 2:
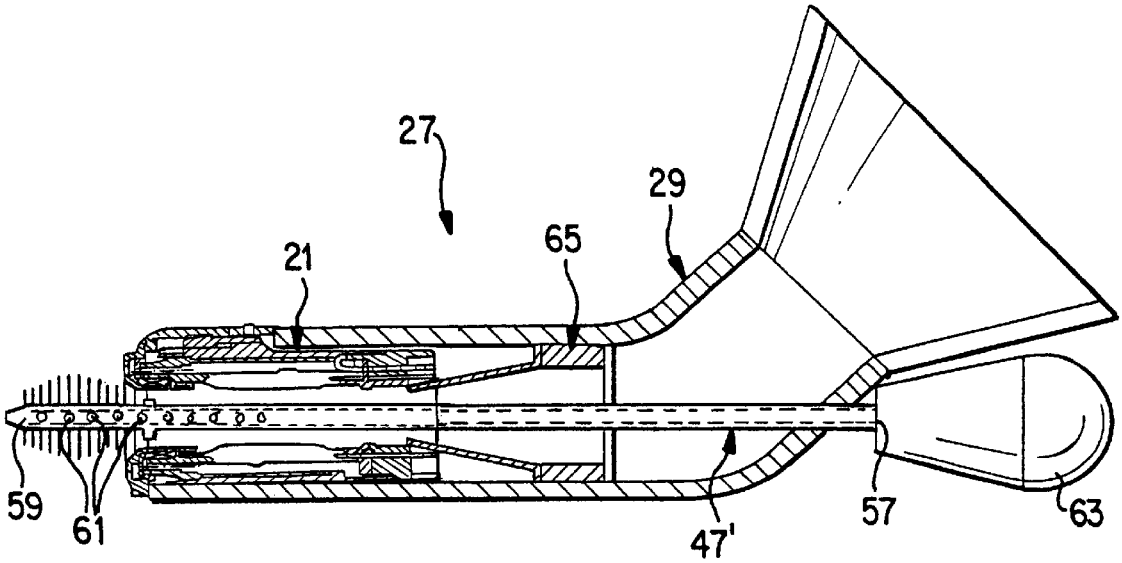
FIG. 2 is a schematic, cross-sectional side view of a brush cleaning unit according to a second embodiment of the present invention.

As seen in a second embodiment shown in FIG. 2, the handle 47' may be hollow and having an open end 57 and a closed end 59. The open end 57 is disposed outside of the tube 29 and the closed end 59 is disposed inside of the tube or outside of the tube downstream from the second end 33. The handle 47' preferably has a plurality of radial openings 61 proximate the closed end 59. The open end 57 is preferably attached to an aqueous medium supply source, such as a tube connected to a faucet, or a compressible bulb 63 attached to the open end of the handle. The closed end 59 of the handle 47' may be in the form of the spray head disclosed in commonly-assigned U.S. patent application Ser. No. 09/176,028 (Attorney Docket No. 021238-264), entitled "Cleaning Unit for the Heater Fixture of a Smoking Device", Inventors Joe Banyasz et al., filed Oct. 21, 1998, which is expressly incorporated by reference. Aqueous medium is preferably forced under pressure from the open end 57 through the radial openings 61 to impinge against the can 25 and further assist in removing condensates.

Figure 3:
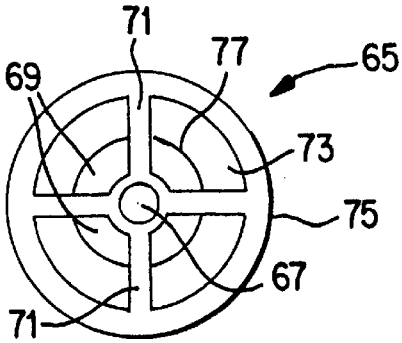
FIG. 3 is a front view of a support for a brush cleaning unit according to an embodiment of the present invention.
Figure 4:
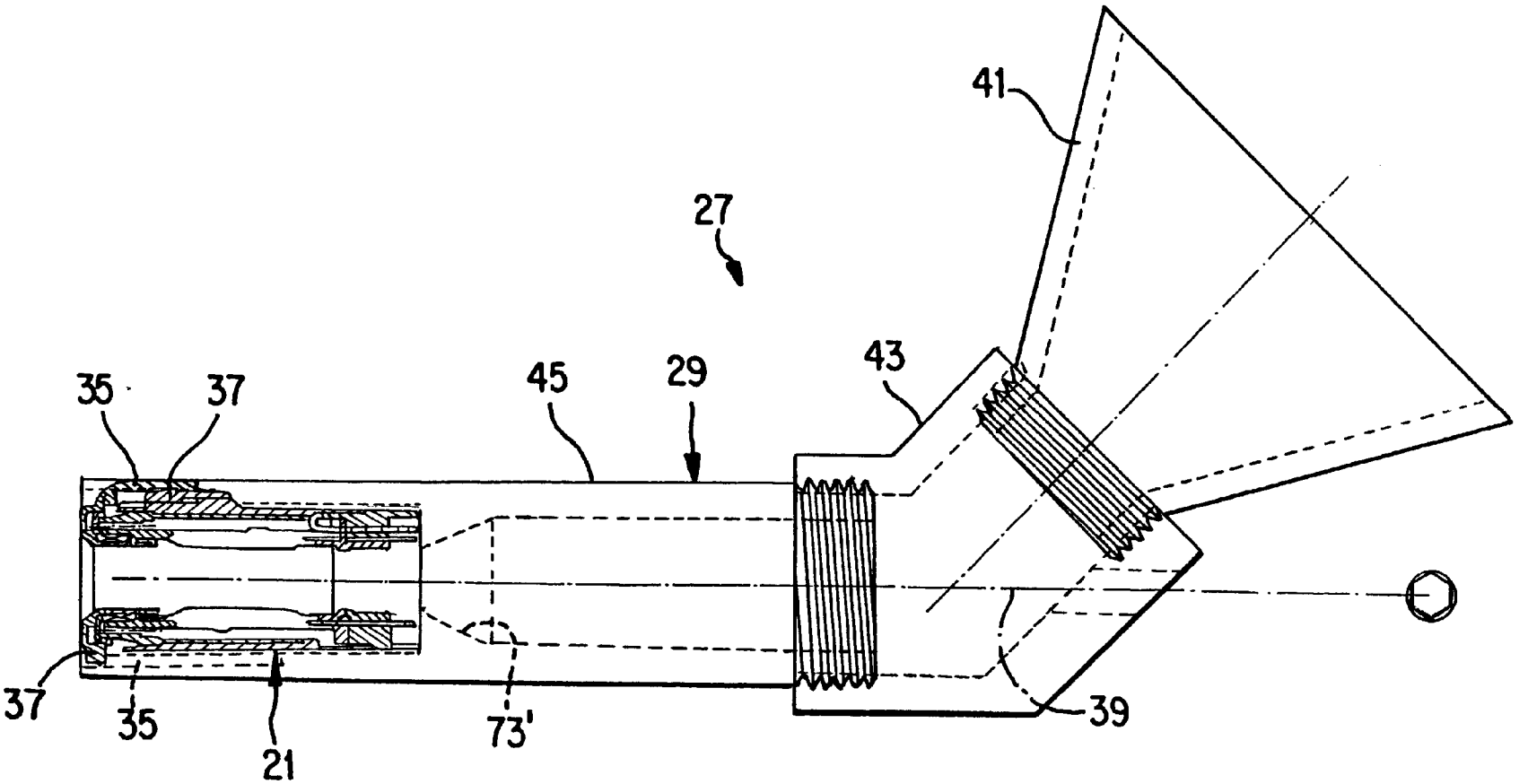
FIG. 4 is a schematic, cross-sectional side view of a brush cleaning unit according to a fourth embodiment of the present invention.

As seen in FIGS. 1 and 2, a support 65 is preferably disposed inside of the tube 29. As seen in FIG. 3, the support 65 preferably has a central opening 67. The support 65 preferably has at least one, preferably plural second openings 69 disposed radially outside of the central opening 67, and the support is preferably in the form of a wagon wheel shape, with a plurality of radially extending spokes 71 extending outwardly from the central opening. As seen in FIGS. 1 and 2, the brush 39 extends through the central opening 67. The support 65 preferably also includes a shield 73 extending in a longitudinal direction of the tube 29 from a main body portion 75 of the support toward the second end 33 of the tube, i.e., in a downstream direction. The shield 73 is preferably in the form of a truncated cone that narrows toward the second end of the tube to a narrow end 77, and the narrow end is preferably narrower than an inside dimension of the heater fixture 21. Preferably, the inside dimension of the heater fixture 21 is in contact with the outside dimension of the shield through a compression fit. Components of the heater fixture 21, such as prongs for electrically connecting the heater fixture to the power supply and control portion of the smoking system, are preferably protected against contact with aqueous medium flowing through the tube 29 by the shield 73. As seen in FIG. 4, if desired or necessary, the support 65 can be omitted entirely. If desired or necessary, a shield 73' can be provided in the absence of a support by forming an inside dimension of the second straight length 45 to narrow as it approaches a rear end of the heater fixture 21. As also seen in FIG. 4, the tube 29 can be formed in a plurality of pieces, such as a separate first straight length 41, second straight length 45, and bent portion 43, and the separate components may be joined together, such as by suitable internal and external threads, adhesive, or the like.

When the heater fixture 21 is positioned relative to the second straight length 45 of the tube 29, a flexible tube 79 is preferably attached to the second end 33 of the tube. The flexible tube 79 facilitates directing the aqueous medium that flows through the tube 29 directly to a drain to the convenience of a user.

Ordinarily, aqueous medium such as water is introduced to the tube 29 through the funnel-shape at the first end 31 of the tube. In addition to or instead of the funnel-shape at the first end 31 of the tube 29, a quick disconnect fitting 81 for attachment to a faucet may be attached to the first end of the tube, thereby minimizing the possibility of splashing of the aqueous medium during use.

In a method for cleaning a heater fixture of a smoking device according to the present invention, the heater fixture 21 is attached to the second end 33 of the tube 29. The heater fixture 21 may be disposed inside of the second straight length 45, partially inside of the second straight length as shown in FIGS. 1 and 2, or outside of the second straight length and fixed to the second end 33 of the tube.

An aqueous medium such as water is supplied to the first end 31 of the tube 29 such that the aqueous medium flows through the tube and an opening in the heater fixture 21 and out the second end 33 of the tube. The bristled portion 55 of the brush 39 that has the handle 47 disposed in and axially movable relative to the opening 49 through a wall of the tube 29 is moved through the opening in the heater fixture to impinge against condensate on the can 25. Because the brush 47 is preferably non-rotatable relative to the opening 49 through the wall of the tube 29 and the heater fixture 21 is preferably non-rotatable relative to the tube, the bristles 55 are preferably oriented in longitudinal rows so that they fit between the blades 23 of the heater fixture and impinge solely against the surface of the can 25. The handle 47 of the brush 39 is preferably also moved through the axial support 65 disposed in the tube. The flexible tube 79 is preferably attached to the second end 33 of the tube 29 and the aqueous medium flowing out of the second end of the tube is directed to a desired location such as a sink drain.

As disclosed in commonly-assigned U.S. patent application Ser. No. 09/188,416 (Attorney Docket No. 021238-270 (PM1853)) entitled "Pump Cleaning Unit for the Heating Fixture of a Smoking Device" to Nichols et al., filed on the same date as the present application, it has been learned that it is particularly advantageous to soak the heater fixture in the aqueous medium. The heater fixture is preferably soaked for about ten minutes, and the aqueous medium used for soaking is preferably about 100° F. to about 150° F., more preferably about 110° F. to about 130° F., and most preferably about 115° F.

The brush cleaning unit according to the present invention has been found to be able to perform at least a comparable cleaning job as the cleaning unit according to U.S. patent application Ser. No. 09/176,028 (Attorney Docket No. 021238-264) that preferably uses a source of running water while using only a fraction of the water used in that cleaning unit. Moreover, the pump cleaning unit according to the present invention can be used in virtually any setting where water can be provided, regardless of whether the tap to be used is a standard size fitting.

While this invention has been illustrated and described in accordance with a preferred embodiment, it is recognized that variations and changes may be made therein without departing from the invention as set forth in the claims.

What is claimed is:

1. A brush cleaning unit for a heater fixture of a smoking device, comprising:

a tube having a first end and a second end, the tube including a portion of a key for cooperating with a corresponding portion of the key on a heater fixture for attaching and orienting the heater fixture relative to the tube;

a brush attached to the tube and axially movable relative to the tube and the heater fixture attached thereto, the brush being non-rotatable relative to the tube.

2. The brush cleaning unit as set forth in claim 1, wherein the tube includes a first straight length extending from the first end to a bent portion, and a second straight length extending from the bent portion to the second end.

3. The brush cleaning unit as set forth in claim 2, wherein the brush includes a handle portion extending from outside of the tube through an opening in the bent portion to inside of the second straight length.

4. The brush cleaning unit as set forth in claim 3, wherein the handle portion and the opening are non-circular.

5. The brush cleaning unit as set forth in claim 3, wherein the handle portion and the opening include a second key and a receptacle for the second key in which the second key is axially movable.

6. The brush cleaning unit as set forth in claim 2, wherein the first end has a larger inside dimension than the bent portion.

7. The brush cleaning unit as set forth in claim 1, wherein the brush includes a handle and a plurality of bristles attached to the handle and arranged in a plurality of longitudinal rows corresponding to locations of spaces between longitudinally arranged heater elements in the heater fixture.

8. The brush cleaning unit as set forth in claim 1, wherein the brush includes a handle, the handle being hollow and having an open end and a closed end, the open end being disposed outside of the tube and the closed end being disposed inside of the tube, the handle having a plurality of radial openings proximate the closed end.

9. The brush cleaning unit as set forth in claim 8, wherein the brush includes a compressible bulb attached to the open end of the handle.

10. The brush cleaning unit as set forth in claim 1, wherein the portion of the key includes a pin receiving opening for receiving the cooperating key portion in the form of a retractable pin on the heater fixture.

11. The brush cleaning unit as set forth in claim 1, wherein the tube includes a side wall having an opening through which the brush extends.

12. The brush cleaning unit as set forth in claim 11, further comprising a support disposed inside of the tube, the support having a central opening, the brush extending through the central opening.

13. The brush cleaning unit as set forth in claim 12, wherein the support has at least one second opening disposed radially outside of the central opening.

14. The brush cleaning unit as set forth in claim 12, wherein the support includes a shield extending in a longitudinal direction of the tube from a main body portion of the support toward the second end of the tube, the shield being in the form of a truncated cone that narrows toward the second end of the tube to a narrow end, the narrow end being narrower than an inside dimension of the heater fixture.

15. The brush cleaning unit as set forth in claim 1, further comprising a flexible tube attached to the second end of the tube.

16. The brush cleaning unit as set forth in claim 1, further comprising a quick disconnect fitting for attachment to a faucet attached to the first end of the tube.

* * * * *